US005615405A

United States Patent [19]

Yamaguchi

[11] Patent Number: 5,615,405

[45] Date of Patent: Mar. 25, 1997

[54] ELECTROPHOTOGRAPHIC IMAGE FORMING APPARATUS WHICH REDUCES AN AREA FOR INSTALLING THE APPARATUS

[75] Inventor: Chiseki Yamaguchi, Tokyo, Japan

[73] Assignee: NEC Corporation, Tokyo, Japan

[21] Appl. No.: 542,953

[22] Filed: Oct. 13, 1995

[30] Foreign Application Priority Data

Oct. 14, 1994 [JP] Japan ..... 6-249233

[51] Int. Cl.[6] ..... G03G 15/00

[52] U.S. Cl. ..... 399/125; 399/388

[58] Field of Search ..... 355/200, 210, 355/245, 309, 308, 260; 347/152

[56] References Cited

U.S. PATENT DOCUMENTS 5,528,342 6/1996 Setoriyama ..... 355/200

FOREIGN PATENT DOCUMENTS 0240337 10/1987 European Pat. Off. .

0565137 10/1993 European Pat. Off. .

0590939 4/1994 European Pat. Off. .

4-247469 9/1992 Japan ..... 355/210 A 4-310968 11/1992 Japan .

5-301398 11/1993 Japan .

6095444 4/1994 Japan .

*Primary Examiner*—Shuk Yin Lee

*Attorney, Agent, or Firm*—Sughrue, Mion, Zinn, Macpeak & Seas

[57] ABSTRACT

The paper feed tray 2 is positioned over the developing device 4 and is fixed to the casing main body 150 to incline with respect to the installing plane 152. The end of the paper in the tray 2 or the front end of the tray 2 faces to the upper surface of the developing device 4. The paper transportation path 3*a* is provided by the toner case 6 of the developing device 4. The paper transportation path 3*a* is connected to the paper transportation path 3*b* which is in parallel to the installing plane 152. Since the paper end in the paper feed tray 2 faces to the upper surface of the developing device 4 and set being inclined, the apparatus width between the manual inputting section 5 and the output section near the output roller R3 can be reduced as compared with the length of the paper feed tray 2. Accordingly, the installation area of the installing plane 152 can be reduced.

7 Claims, 5 Drawing Sheets

ELECTROPHOTOGRAPHIC IMAGE FORMING APPARATUS WHICH REDUCES AN AREA FOR INSTALLING THE APPARATUS

BACKGROUND OF THE INVENTION

1. Field of the Invention

The present invention relates to an electrophotographic image forming apparatus such as a copying machine and a printer, and more in particular to the electrophotographic image forming apparatus which reduces an area for installing the apparatus.

2. Description of the Prior Art

An image forming apparatus such as a printer is generally connected as a peripheral equipment to a superior device, such as computer. When an operator activates printing operation from the superior device, a predetermined printing output is obtained from the image forming apparatus. Considering the operation efficiency, it is most desirable that the superior device and the image forming apparatus are disposed at an identical place. Particularly, in the apparatus to be connected with a desktop type superior device such as a personal computer or an engineering work station, the best arrangement is such one as the superior device and the image forming apparatus are disposed on one identical desk, and thereby an operator's working space is ensured. Recently, ink jet type printers has been reduced in the size as capable of providing the foregoing circumstance is available. However, a further size reduction is necessary for the electrophotographic type apparatus. To reduce the size, various improved inventions have been made. Such examples of the prior art image forming apparatus are to be explained with reference to FIG. 1 to FIG. 3.

In FIG. 1, a photoconductor drum 51 is provided on a paper feeding path 50 which is disposed in parallel with a bottom of the printing apparatus of FIG. 1, and a developing device 54 and other image forming devices 52 and 53 are disposed at the periphery thereof. The developing device 54 produces toner images on the surface of the photoconductor drum 51. A transfer device 55 for transferring toner images to a sheet of paper is disposed by way of a paper transportation path just beneath the photoconductor drum 51. The sheet of paper sent from a paper cassette (not shown) is transferred with the toner images of the photoconductor drum 51 by the transfer device 55 and then fixed with the toner images by a fixing device 58 disposed near the downstream end of the paper feeding path 50 and then discharged. A cleaning device 56 removes the remaining toner on the photoconductor drum 51.

Such a constitution has a laterally elongate constitution by restricting the height to some extent.

Further, another image forming apparatus as shown in FIG. 2 has also been used at present. In FIG. 2, a cleaning device 62 including cleaning roller 63 and a developing device 65 are disposed so as to vertically put a photoconductor drum 61 therebetween and a paper transportation path is disposed so as to surround a lateral portion of them vertically for one-half circumference. A transfer section 66 is disposed corresponding to the photoconductor drum 61 on the side of the paper transportation path, and an exposure section 64 is provided on the opposite side by way of the photoconductor drum 61. The sheet of paper is fed by a paper cassette 68 disposed in parallel with an installing plane and discharged along the paper transportation path to a fixing device 67.

With a such a constitution, the lateral width of the apparatus is reduced compared with the prior art example shown in FIG. 1 because the paper cassette 68 is positioned beneath the printing device.

On the other hand, Japanese Patent laid-open Hei 5-301398 discloses another image forming apparatus as shown in FIG. 3. The image forming apparatus has a paper transportation path 71 substantially in parallel with an installing plane 78, a photoconductor drum 74 disposed at a central portion of the apparatus along the paper transportation path 71, and developing device 77 and other image forming devices disposed so as to surround the photoconductor drum 74. A paper feed cassette 72 and a paper discharge tray 73 are stood vertically in the upper portion of the apparatus. Among them, the paper feed cassette 72 is provided above the upstream end of the paper transportation path 71 being inclined outwardly, and a pick roller 70 is disposed between the paper delivery side thereof and the developing device 77. This is intended for the size reduction.

In addition to them, as shown, for example, in Japanese Patent Laid-Open Hei 4-310968, there is also such an image forming apparatus that an electric equipment portion for controlling the image forming operation, a paper transportation path and a developing section are located successively above a paper cassette loaded in parallel with the installing plane thereby reducing the size of the apparatus.

However, each of the foregoing examples of the prior art involves the following disadvantages.

In the image forming apparatus shown in FIG. 1, since the paper transportation path 50 is disposed in parallel with the installing plane, and the paper cassette is loaded in parallel with the installing plane at the upstream end thereof, it requires a lateral width at least about twice the paper length and has a disadvantage of requiring a large installation area.

In the image forming apparatus shown in FIG. 2, since the paper cassette 68 is loaded in parallel with the installing plane, it is impossible to shorten the width of the apparatus depending on the length of the paper cassette 68. Therefore, it suffers from a disadvantage that the installing area can not physically be reduced.

In the image forming apparatus shown in FIG. 3, the paper feed cassette 72 is stood vertically being inclined outwardly, and the pick roller 70 has to be disposed between the paper feeding side of the paper feed cassette 72 and the developing device 77. Therefore, it is difficult to shorten the paper transportation path between the paper feed cassette 72 and the developing device 77. Accordingly, although the feed cassette 72 is installed above the apparatus, there is a drawback that the effective installing area can not actually be diminished.

Further, also the image forming apparatus as disclosed in Japanese Patent Laid-Open Hei 4-310968, since the paper cassette is loaded in parallel with the installing plane like that illustrated in FIG. 2, it is impossible to shorten the width of the apparatus than the length of the paper cassette on the installing plane and it involved a disadvantage that the installing area could not be reduced to more than a predetermined extent from a physical point of view.

SUMMARY OF THE INVENTION

It is an object of the present invention to provide an image forming apparatus improved for such disadvantages involved in the prior art image forming apparatus and, particularly, intended for further reducing the size of the installing area of the apparatus.

A paper forming apparatus of the present invention comprises printing device having electrophotographic printing function, a paper feed tray for stacking sheets of paper, and a paper feeder for feeding one of the stacked sheets of paper to a paper feeding side.

The printing device includes a photoconductor drum, developing device for developing electrostatic latent images formed on the outer circumferential periphery of the photoconductor drum with toners installed in a case, transfer device for transferring developed toner images to a sheet of paper, and fixing device for fixing the toner images transferred by the transfer device.

A paper transportation path, for feeding the paper fed from the paper feed tray to an upstream portion of said transfer device, is provided.

The paper feed tray is inclined with respect to an installing plane of the image forming apparatus, with being slightly downward in the paper feeding direction. The paper feed tray is disposed over the developing device so that the end of the paper on the paper feed tray faces to an upper surface of the case of said developing device. The paper transportation path is formed by an outer surface of the case of the developing device in an arcuate shape.

In addition to them, a manual paper inputting section may be disposed to the upstream of the transfer device, and the paper transportation path extended from the manual paper inputting section to the transfer device may be set substantially in parallel with the bottom of a casing main body.

Alternatively, a manual paper inputting section may be disposed to the upstream of the transfer device, and the paper transportation path extended from the paper feeding side of the paper feed tray to the fixing device may be entirely set into a curved configuration.

DETAILED DESCRIPTION OF THE PREFERRED EMBODIMENTS

Figure 4:
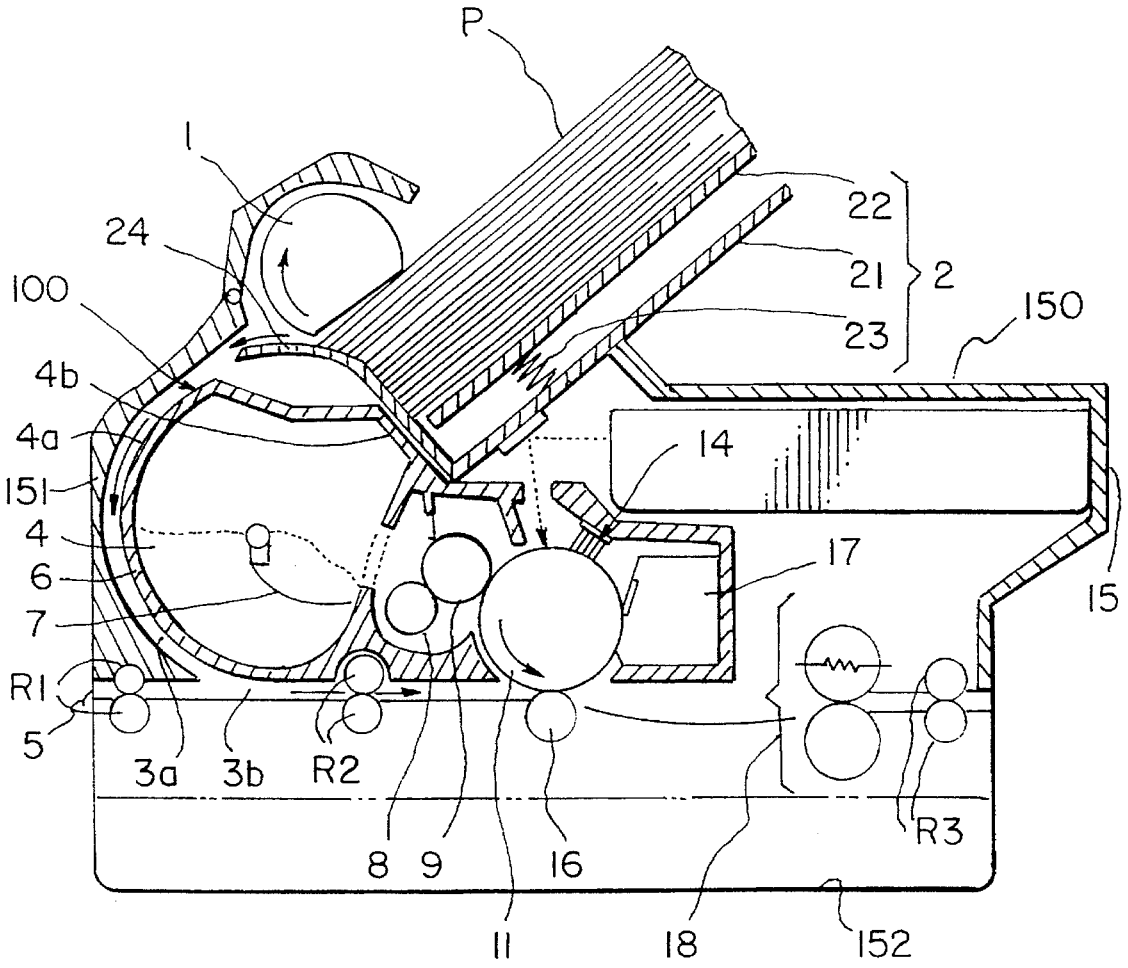
FIG. 4 is a cross section illustrating an image forming apparatus according to an embodiment of the present invention.
Figure 5:
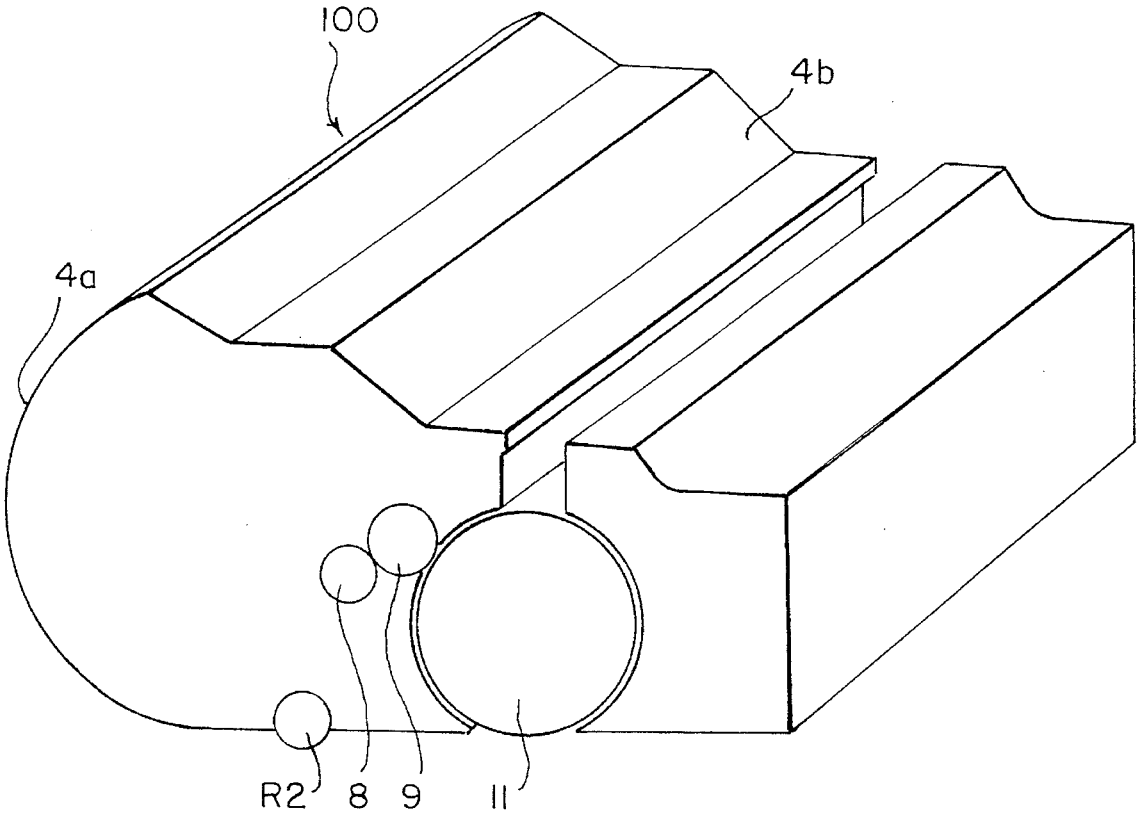
FIG. 5 is a perspective view illustrating a electrophotographic functioning cartridge used in the image forming apparatus shown in FIG. 4.

Referring to FIG. 4, an image forming apparatus using an electrophotography is shown. The image forming apparatus includes a cylindrical photoconductor drum 11, a paper feed tray 2, charging device 14 using a charging brush, laser optical system 15, transfer roller 16, cleaning device 17, and roller type fixing device 18. The photoconductor drum 11, developing device 4, charging device 14, transfer roller 16 and cleaning device 17 are fixed in one case as a electrophotographic functioning cartridge 100 as shown in FIG. 5.

The paper feed tray 2 is located over the developing device 4. The paper feed tray 2 is entirely inclined about 45 degree and ends of the papers on the paper feed tray 2 is directed downward in the paper feeding direction. The paper end of a top paper is directed to the upstream end of a paper transportation path 3*a*. Further, a quonset-shaped pick roller 1 is disposed adjacent to the paper feeding side of the paper feed tray 2.

Now, referring more specifically, the paper feed tray 2 is provided with a main tray body 21 fixed to a casing main body 150 of the image forming apparatus, a press plate 22 for supporting sheets of paper P contained in stack in the tray main body 21 integrally from the bottom, and a push-up spring 23 for always resiliently biasing the press plate 22 to the pick roller 1. The paper delivery portion 24 of the tray main body 21 is formed into an arcuate shape so as to be connected smoothly with the arcuate paper transportation path 3*a*. The inclination angle of the paper feed tray 2 may be set depending, for example, on the length of the sheet of paper to be used. Further, a reflection mirror 25 is disposed to the rear face of the tray main body 21 for reflecting the laser beam irradiated from the laser optical system 15 to the photoconductor drum 11.

The paper transportation path 3*a* having arcuate shape is constructed by an outer side surface 4*a* of the developing device 4 and an inner surface of a side cover 151. The side cover 151 is rotatable or removable outwardly so that the case 100 can be removed from the left side of the casing main body 150. A paper transportation path 3*b* is coupled to the lower portion of the paper transportation path 3*a* and is disposed in parallel with an installing plane 152 of the casing main body 150. A manual inputting section 5 is disposed to the upstream end of the paper transportation path 3*b*. Transportation rollers R1, R2 and the transfer roller 16 for transferring an toner image to the paper are located in the paper transportation path 3*b*, and the fixing device 18 and an output feed roller R3 is located toward the downstream end of the transportation path 3*b* respectively being spaced apart from each other. The transfer roller 16 is disposed below the photoconductor drum 11. The paper fed from the manual section 5 or from the paper transportation path 3*a* is fed to the roller R2 and then transported to between the photoconductor drum 11 and the transfer roller 16.

The developing device 4 is disposed between the paper transportation path 3*a* and the photoconductor drum 11. The outer side surface 4*a* of the developing device 4 supplementally constitutes one of wall surfaces of the paper transportation path 3*a*. An upper inclined surface 4*b* of the developing device 4 faces to the end of the papers on the tray main body 21. The developing device 4 has a toner case 6, stirring member 7, feeder roller 8 and toner carrying roller 9 therein. Toners in the toner case 6 have negative charge characteristics. The toners are stirred by the stirring member 7. This stirring directs the toners to the feeder roller 8. The toners fed to the feeder roller 8 are transferred to the toner carrying roller 9. The toners on the toner carrying roller 9 are transferred to the photoconductor drum 11 to produce toner images.

The laser optical system 15 is disposed above the fixing device 14 for exposing the outer surface of the photoconductor drum 11 and producing electrostatic latent image thereon. A control circuit (not illustrated) for controlling the printing operation are contained at the bottom of the casing main body 15.

Operation of this embodiment will be explained below.

When the image forming apparatus of FIG. 4 is set to an operation state and an external printing command is received, the pick roller 1 rotates in the paper feeding direction to gradually feed first sheet of paper P contained in stack in the paper feed tray 2 to the paper transportation path 3*a*. The fed paper slides in the paper transportation path 3*a* on the developing device 4, and the end of the paper finally reaches the junction with the paper transportation path 3*b*. Then, when the paper leaves the pick roller 1 and the top end reaches the transportation roller R2, the paper is temporarily kept there and then sent to the transfer roller 16 in accordance with the rotation of the photoconductor drum 11 on which the toner images are formed by cooperation of the charging device 14, the laser optical system 15 and the developing device 4. The paper transferred with the toner images by the transfer device 16 is fixed with the toner images at the fixing device 18 and then discharged out of the casing main body 150. In a case of continuous printing, after the rear end of the preceding paper is transported by the pick roller 1, the succeeding paper is fed after the elapse of a predetermined period of time.

Further, when a sheet of paper is inserted into the manually inputting section 5, insertion of the paper is detected by the function of the paper detection sensor (not illustrated) disposed to the transportation roller R1. In this case, the paper feeding from the paper feed tray 2 is not conducted in the printing operation. This is adapted to obtain an identical printing output with that fed from the paper feed tray 2.

In FIG. 4, a paper stack may be fixed to the casing main body 150 to stack the printed papers.

Figure 1:
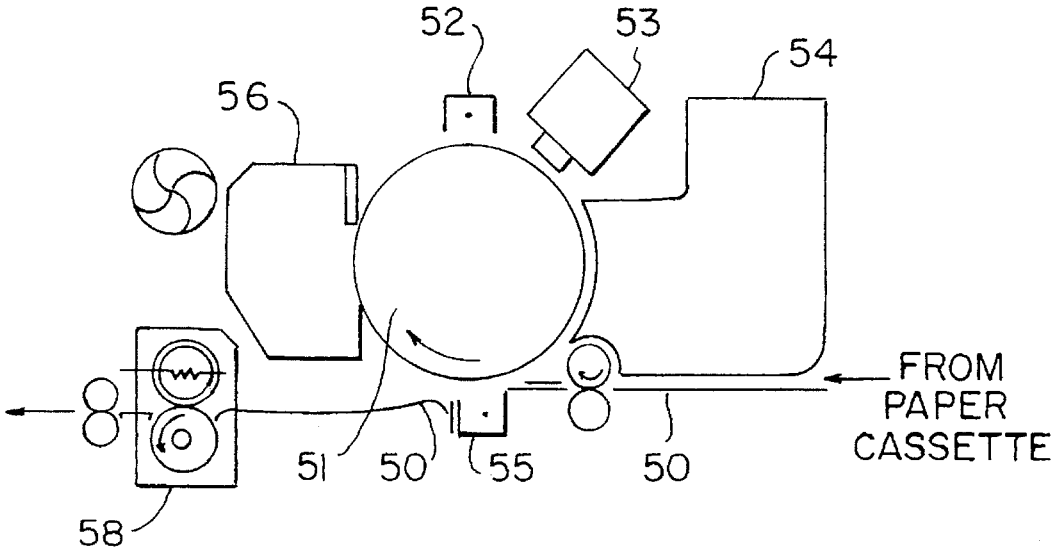
FIG. 1 PRIOR ART
FIG. 1 is a constitutional view illustrating a conventional image forming apparatus.
Figure 2:
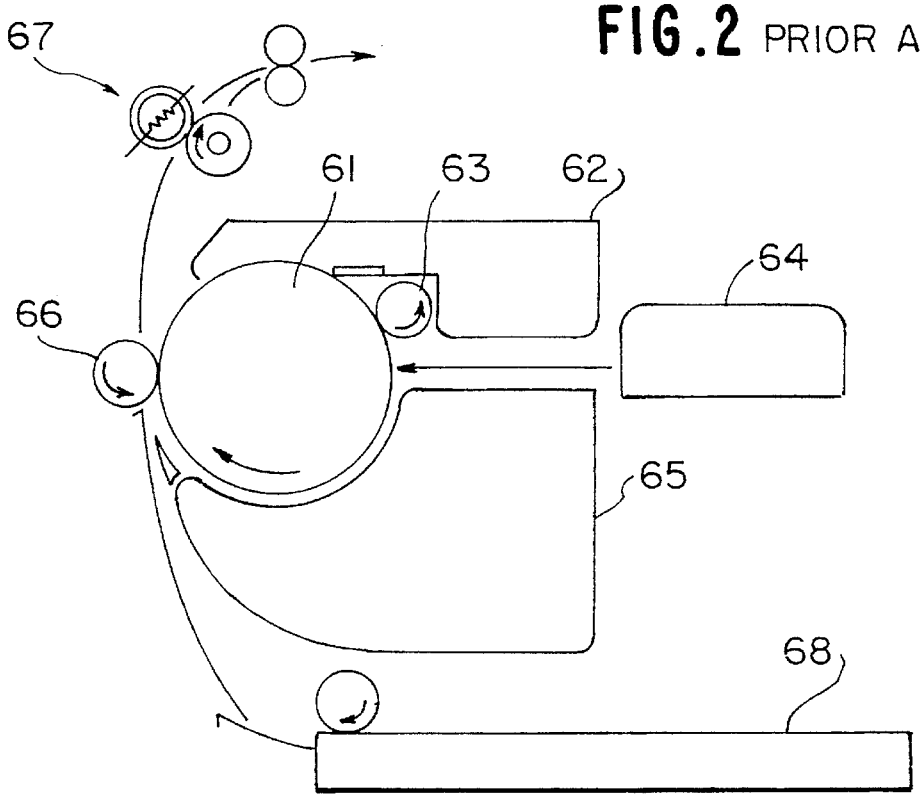
FIG. 2 PRIOR ART
FIG. 2 is a constitutional view illustrating another conventional image forming apparatus.
Figure 3:
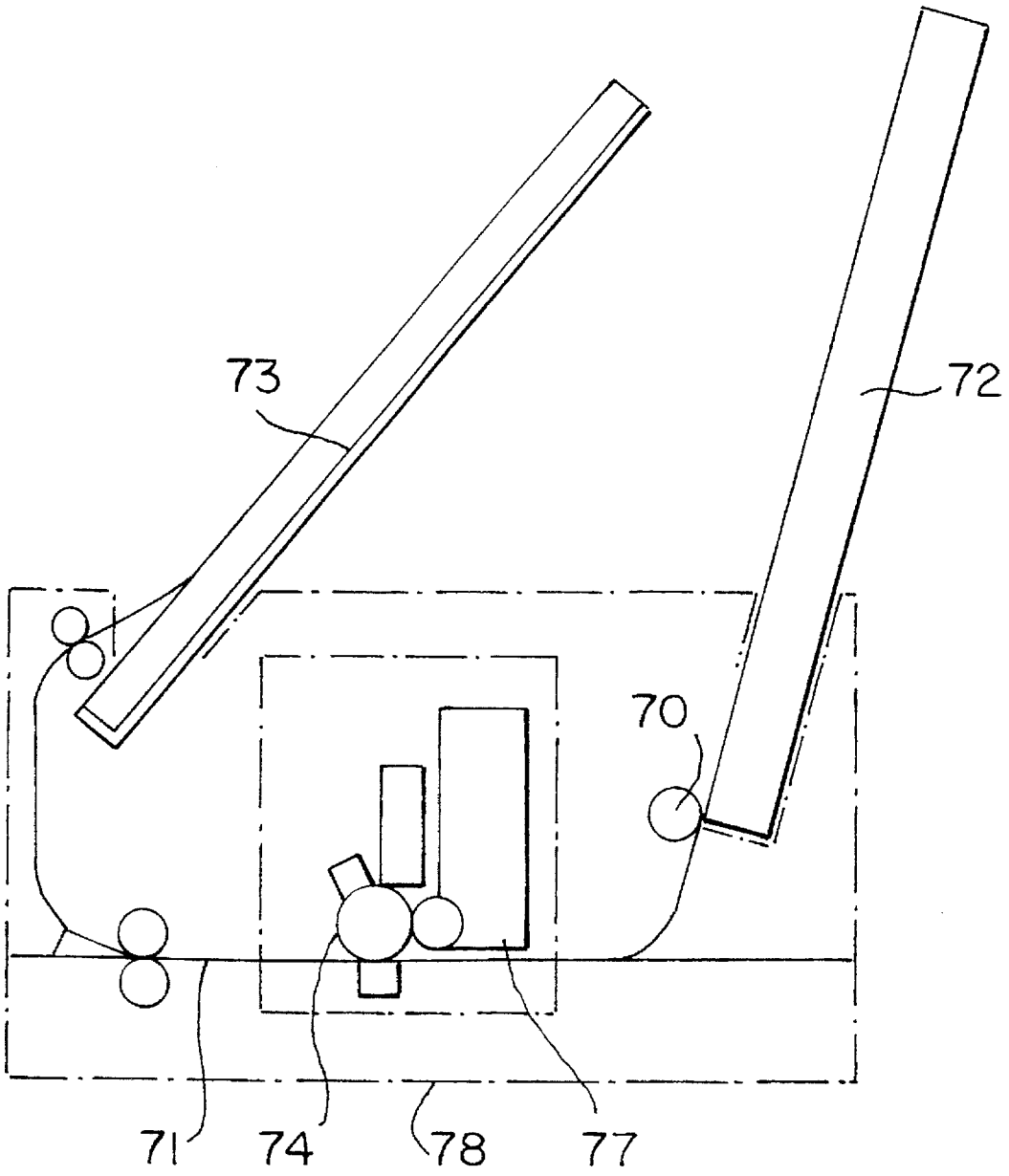
FIG. 3 PRIOR ART
FIG. 3 is a constitutional view illustrating a still further conventional image forming apparatus.

According to the embodiment of FIG. 4, printing output as usual can be obtained, as well as the apparatus width can be reduced as compared with the width of the existent paper cassette. This is because a paper cassette provided in parallel with the installing surface of the apparatus like the image forming apparatus shown in FIGS. 1 and 2, is not used but the paper feed tray 2 is provided over the apparatus and set being inclined, and because the end of the papers on the paper feed tray 2 faces to the upper surface of the developing device 4. The apparatus width between the manual inputting section 5 and the output section near the output roller R3 can be reduced as compared with the length of the paper feed tray 2. Accordingly, the installation area of the installing plane 152 can be reduced.

Further, in this embodiment, the pick roller 1 is disposed above the upper surface of the developing device 4, and the upper surface of the developing device 4 and the paper feed tray 2 are disposed in an intimate contact. Therefore, the installation area of the installing plane 152 can be reduced remarkably.

Since the manual inputting section 5 is disposed to the upstream end of the paper transportation path 3*b* disposed linearly in parallel with the installing plane 152, no paper feeding disorder such as paper jam is generated associated with a rigid printing medium such as a cardboard or an envelope and an identical printing output with that of usual paper sheet can be obtained.

Since the paper transportation path 3*a* leading from the paper feed tray 2 to the roller R2 and the transfer roller 16 is formed in a smooth arcuate shape, the sheet of paper does not suffer from excess loading force during transportation thereby enabling to effectively moderate disadvantages such as paper flexing or paper curling.

Since the electrophotographic functioning cartridge 100 including the photoconductor 11 and the developing device 4 is disposed on the paper transportation path 3*b* and the cartridge 100 is positioned adjacent to the removable or opening-closing type side cover 151, the cartridge 100 can be removed along the paper transportation path 3*b* and thereby the maintenance of the cartridge 100 becomes easier. Moreover, the jammed paper in the paper transportation paths 3*a* and 3*b* are easily removed.

In addition, various advantages can be obtained in that since one of wall surfaces of the paper transportation path 3*a* formed into an arcuate shape is supplementally completed by the wall surface of the developing device 4, the number of parts for forming the paper transportation path can be reduced. Since the installation area of the installing plane 152 can be reduced remarkably, the apparatus can be disposed also near the wall and can effectively utilize the space, for example, in a case of putting the apparatus on the desk.

Another embodiment of the present invention will be explained with reference to FIG. 6.

Figure 6:
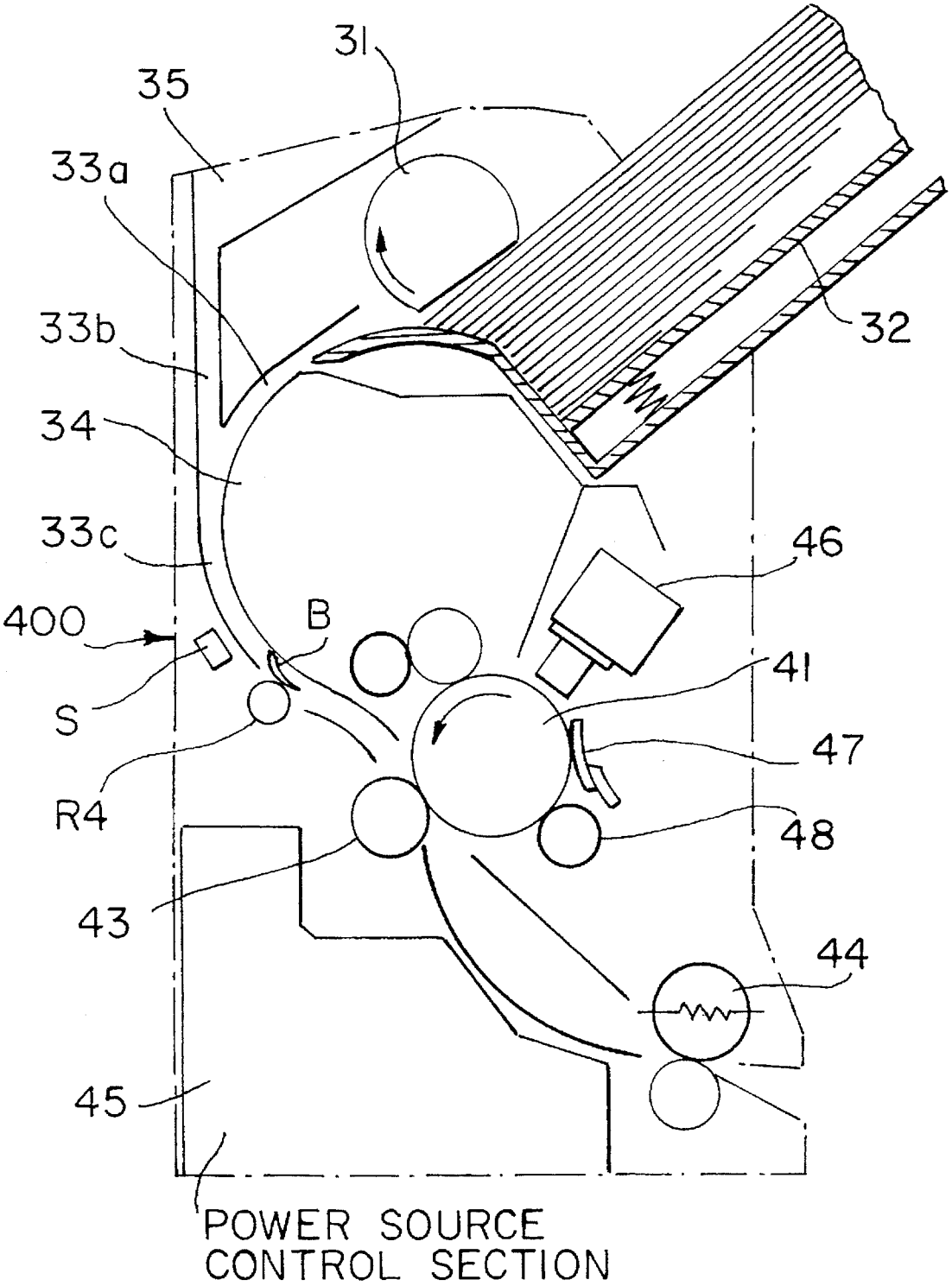
FIG. 6 is a constitutional view illustrating another embodiment according to the present invention.

In FIG. 6, a paper feed tray 32 is disposed above a developing device 34. The paper feed tray 32 is set entirely obliquely with being directed downward in the paper feeding direction, and a top paper on the paper feed tray 32 is directed to the upstream end of a paper transportation path 33*a*. A quonset-shaped pick roller 31 is disposed at the paper delivery side of the paper feed tray 32 on the side opposite to the developing device 34.

An upper surface of the developing device 34 faces to the front end of the paper feed tray 32 as like the embodiment of FIG. 4. The paper transportation path 33*a* is constructed by the outer surface of the developing device 34 and is set into a curved configuration.

A photoconductor drum 41 is disposed under the developing device 34 along the paper transportation path 33*a*, and a transfer roller 43 is opposed to the photoconductor drum 41 by way of the paper transportation path 33*b*. A roller type fixing device 44 is disposed to a downstream of the paper transportation path 33*b*. No members are disposed above the fixing member 44 but a space is secured above that. The space is so constituted by considering the temperature elevation of the fixing device 44, and cooling device such as a louver may be disposed externally to the portion.

A paper sensor S is disposed at a position corresponding to the developing device 34 along the paper transportation path 33*b*, and a transportation roller R4 of a small diameter and a leaf spring B always biased resiliently to the transportation roller R4 are disposed being opposed to each other just downstream of the sensor S. The leaf spring B is for attaining reliable paper transportation.

A paper transportation path 33*c* is disposed vertically to the upper left side in FIG. 2 and connected to the path 33*b*. It is for manual inputting, to which a manual inputting portion 35 and a paper transportation path 33*a* are connected. Since this causes manually inputted paper sheet to fall gravitationally in a vertical direction, paper transportation, image formation and paper discharge can be attained only by the roller R4, the transfer roller 43 and the fixing device 44 without using transportation roller other than the transportation roller R4 in the paper transportation path.

Around the periphery of the photoconductor drum 41, are disposed a charging device 47 made of a conductive rubber plate, an LED array optical system 46 for exposing the photoconductor drum 41, and a residual toner dispersing roller 48, respectively. Further, an apparatus power source and an operation control section for the apparatus are provided at the bottom portion 45 of the apparatus. Then, each of the constitutional elements is contained to an appropriate portion in the elongate casing main body 400. In this embodiment, a function of cleaning the photoconductor drum 41 is equipped to the developing device 34. Other constitutions are identical with those in the first embodiment described previously.

Then, operation of this embodiment will be explained.

When the image forming apparatus is set to an operation state and an external printing demand is received, the pick roller 31 rotates in the paper sending direction, and a first sheet of paper P contained in stack on the paper feed tray 32 is gradually fed to the paper transportation path 33*a*. The fed sheet of paper slides along a smooth wall surface of the paper transportation path 33*a* supplementally completed by one wall surface of the developing device 34, and reaches the transportation roller R4. The sheet of paper is temporarily put between the transportation roller R4 and the leaf spring B and sent to the transfer device 44 in accordance with the rotation of the photoconductor drum 41 formed with toner images by cooperation of the charging device 47, the laser optical system 46 and the developing device 44. The sheet of paper transferred with toner images by the transfer roller 43 is fixed with the toner images in the fixing device 44 and discharged out of the apparatus. In a case of continuous printing, after the rear end of the preceding sheet of paper has been transported by the pick roller 31, the succeeding sheet of paper is fed after the elapse of a predetermined period of time.

Further, when a sheet of paper is inserted from the manual inputting portion 35 during stoppage of the printing operation, the sheet of paper is fallen gravitationally as far as the transportation roller R4 and then retained. In this case, the paper detection sensor S detects the sheet of paper. Subsequently, when an external printing instruction is given, a printing operation identical with that for paper fed from the paper feed tray 32 is conducted to the manually inputted sheet of paper.

As described above, since this embodiment has the same function and effect as those in the first embodiment described previously, as well as the paper transportation path is formed into the curved configuration, the installation area of the apparatus can further be reduced as compared with the first embodiment.

In this case, in each of the embodiments described above, the paper feed tray may be disposed in plurality in accordance with the size of the paper sheet. In this case, the paper feed tray is desirably disposed above in a multistage together with the pick roller. The transfer device is not restricted to a roller shape but corotron type or saw teeth discharge electrode, etc. may also be used. The charging device may be a scorotron, rotational brush or roller. Further, not only a photoconductor body but also a dielectric body may be used for image formation by electronic photography. In this case, an electrostatic head is used for forming images. The fixing device is not restricted to the roller type but it may be based on a pressure method or a thin film fixing method.

According to the present invention having the function and constituted as described above, since the paper feed tray is disposed over the developing device and set obliquely, without using the paper cassette disposed in parallel with the installing plane of the apparatus as in the prior art, the apparatus width can be reduced. Accordingly, it is possible to reduce the installation area compared with the prior art image forming apparatus. Further, since the end of the papers on the paper feed tray is directed to the upper surface of the developing device, the developing device and the paper feed tray can be provided in an intimate contact, so that the apparatus width can be reduced remarkably to thereby further reduce the installation area for the entire apparatus. Actually, since the installation area can be reduced about to the area of the sheet of paper used (3/5½ size as compared with the existent desktop type printer of the same class), if they are disposed on the desk together with the superordinate device, an operation space can be ensured on one identical desk.

Further, since the paper transportation path leading from the paper feed tray to the transfer section is formed into the arcuate shape, the sheet of paper suffers from no excess loading force during transportation and disadvantages such as paper flexure or paper curling can be moderated effectively.

What is claimed is:

1. An image forming apparatus comprising:

printing means including a photoconductor drum, developing means for developing electrostatic latent images formed on an outer circumferential periphery of the photoconductor drum with toners installed in a toner case, transfer means for transferring developed toner images to a sheet of paper, and fixing means for fixing the toner images transferred by the transfer means; and paper feeding means for stacking sheets of paper and feeding one of the stacked sheets of paper to said printing means, wherein said paper feeding means is entirely set obliquely with being slightly downward in a paper feeding direction, and said paper feeding means is disposed over said developing means so that ends of said sheets of paper stacked in said paper feeding means face to an upper surface of said case of said developing means, and a paper transportation path, for feeding the paper fed from said paper feeding means to an upstream portion of said transfer means, is formed by an outer surface of said toner case of said developing means in an arcuate shape.

2. The image forming apparatus as defined in claim 1, wherein said paper transportation path comprises a first paper transportation path which is formed by the outer surface of said case of said developing means in an arcuate shape and a second paper transportation path which is located under said developing means in parallel with an installing plane of the image forming apparatus and is connected to said transfer means.

3. The image forming apparatus as defined in claim 2, wherein said second paper transportation path is connected to manual paper inputting means which is disposed to the upstream portion of said transfer means.

4. The image forming apparatus as defined in claim 1, further comprising:

a casing main body which equips with said printing means and said paper feeding means; and a electrophotographic cartridge which cases said photoconductor drum and said developing means, wherein said toner case is provided with said electrophotographic cartridge.

5. The image forming apparatus as defined in claim 4, wherein said casing main body has a cover facing to said toner case and removable, and said paper transportation path is provided between said cover and said toner case to pass the paper fed from a paper feeding side of said paper feeding means.

6. An image forming apparatus comprising:

a photoconductor drum;

developing means for developing electrostatic latent images formed on an outer circumferential periphery of the photoconductor drum with toners installed in a case;

transfer means for transferring developed toner images to a sheet of paper;

fixing means for fixing the toner images transferred by the transfer means;

paper feed tray for stacking sheets of paper;

paper feeder for feeding one of the stacked sheets of paper in a paper feeding direction; and a paper transportation path for feeding the paper fed from said paper feed tray to an upstream portion of said transfer means, wherein said paper feed tray is inclined with respect to an installing plane of said image forming apparatus, with being slightly downward in said paper feeding direction, and said paper feed tray is disposed over said developing means so that the front end of said paper feed tray faces to an upper surface of said case of said developing means, and said paper transportation path is formed by an outer surface of said case of said developing means in an arcuate shape.

7. The image forming apparatus as defined in claim 6, wherein said photoconductor drum and said fixing means is located under said developing means.

* * * * *